United States Patent [19]

Nam et al.

[11] Patent Number: 4,847,946

[45] Date of Patent: Jul. 18, 1989

[54] HYDRAULIC DOOR CLOSER

[75] Inventors: Sun O. Nam; Wan S. Lee, both of Seoul; Jae Y. Yoo, Kyeongki, all of Rep. of Korea

[73] Assignee: Sam Kyong Hardware Co., Ltd., Seoul, Rep. of Korea

[21] Appl. No.: 172,431

[22] Filed: Mar. 24, 1988

[51] Int. Cl.[4] ..... E05F 3/12

[52] U.S. Cl. ..... 16/53; 16/58; 16/71; 16/82; 16/DIG. 9; 16/DIG. 17; 16/DIG. 21

[58] Field of Search ..... 16/53, 58, 62, 79, DIG. 9, 16/DIG. 17, DIG. 21

[56] References Cited

U.S. PATENT DOCUMENTS

| | | | |
|---|---|---|---|
| 3,675,270 | 7/1972 | Jentsch | 16/53 |
| 4,010,572 | 3/1977 | Peterson | 16/62 |
| 4,285,094 | 8/1981 | Levings, Jr. | 16/58 |
| 4,376,323 | 3/1983 | Tillmann | 16/51 |
| 4,378,612 | 4/1983 | Beers | 16/62 |
| 4,414,703 | 11/1983 | Schnarr et al. | 16/52 |
| 4,455,708 | 6/1984 | Saigne | 16/56 |
| 4,483,043 | 11/1984 | Tillmann | 16/56 |

*Primary Examiner*—Nicholas P. Godici
*Assistant Examiner*—Edward A. Brown
*Attorney, Agent, or Firm*—James Creighton Wray

[57] ABSTRACT

A new type of hydraulic door closer is disclosed. The device of the present invention utilizes spring force and hydraulic pressure, and is equipped with a straightly extending arm instead of the conventional type of the folding arms. The advantages of the device of the present invention are that variations of the size of the device are not required for different sizes and weights of doors, and the lack of the folding portion of the arm enables avoiding of wear and stress on the critical parts. Another advantage of the device of the present invention is that different door opening ranges are provided such as 80 degrees, 90 degrees and 100 degrees in addition to a free moving zone.

4 Claims, 8 Drawing Sheets

HYDRAULIC DOOR CLOSER

FIELD OF THE INVENTION

The present invention relates to a hydraulic door closer based on a new technical constitution.

BACKGROUND OF THE INVENTION

Generally in using a door, it will be convenient if the door is moved lightly and fast when opening, but slowly when closing. It is also desirable that, when closing, a door is slowly fitted back without generating any impact after making a preliminary stopping.

The typical conventional door closers which are widely used are constituted such that a rack is elastically supported by a spring installed within the hydraulic chamber, the rack is meshed to a pinion, and a link is actuated by means of such mechanism. But in such conventional hydraulic door closers, the total inner space is used as the hydraulic chamber, and the pinion is positioned under the rack. This means that the force-receiving point deviates from the centre, and therefore, the door is hard to open, while the door, when released, quickly rushes back with a strong force due to the reacting force of the spring.

Further such conventional hydraulic door closers require the sealing of the opposite ends of the main body and the opposite sides of the pinion, thereby rendering the constitution more complicated. Such structure increases the possibility of the leaking of the hydraulic fluid. A further inconvenience is that, in order to keep the door at a certain opening angle, the bottom of the door has to be supported by means of a separate object. Also the main body of the closer is necessarily enlarged in order to acommodate the spring, thereby aggravating the external appearance and the commercial merit.

Further such conventional door closers use two arms which are connected by means of a hinge, and which are actuated in a folding type. Therefore all the force is imposed on the link mechanism, and consequently, friction and wear on the hinge is severe, and the arms are twisted or bent.

Thus the conventional door closers have problems both in the inner mechanism and on the external arms, and therefore, they have to undergo excessive operating loads together with frequent operating disorders.

SUMMARY OF THE INVENTION

The object of the present invention is to provide a hydraulic door closer in which a point contact is formed between a cam and a piston in order to uniformly distribute the force and to disperse the concentration of the load for a smooth operation of the device; and the closer is simplified in its constitution and miniaturized in its size, whereby improving its commercial merit and extending its life expectancy.

Another object of the present invention is to provide a hydraulic door closer in which the returning force of the door is temporarily supressed during the final stage of the closing process in order to provide a safety distance for preventing the impact of the door; the door, when being opened, opens lightly and fast; and the door can be kept opened at any desired angle, whereby providing a convenience in using the door.

Still another object of the present invention is to provide a hydraulic door closer in which the arm is not constitued in a hinged type but in a cylinder type, providing a straight movement of the arm in order to remove unfavorable influences from the arm and to assure a smooth returning movement of the door.

BRIEF DESCRIPTION OF THE DRAWINGS

The above objects and other advantages of the present invention will become more apparent by describing the present invention in more detail with reference to the attached drawings in which.

DESCRIPTION OF THE PREFERRED EMBODIMENT

Figure 1:
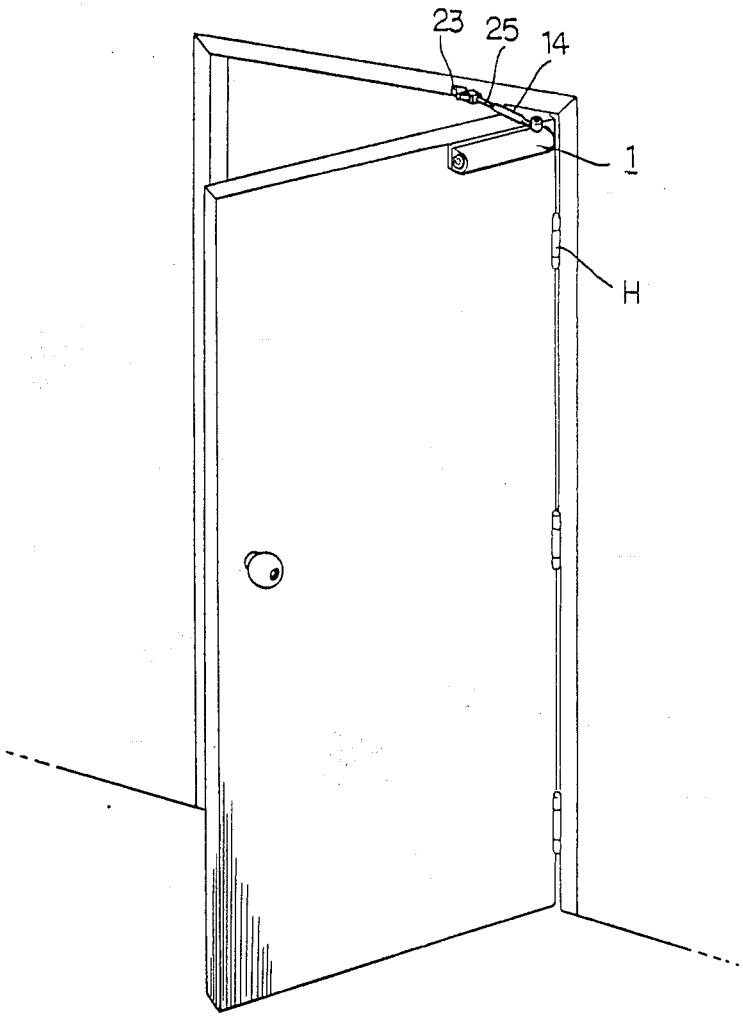
FIG. 1 shows the door closer of the present invention being used after having been installed on a door.
Figure 2:
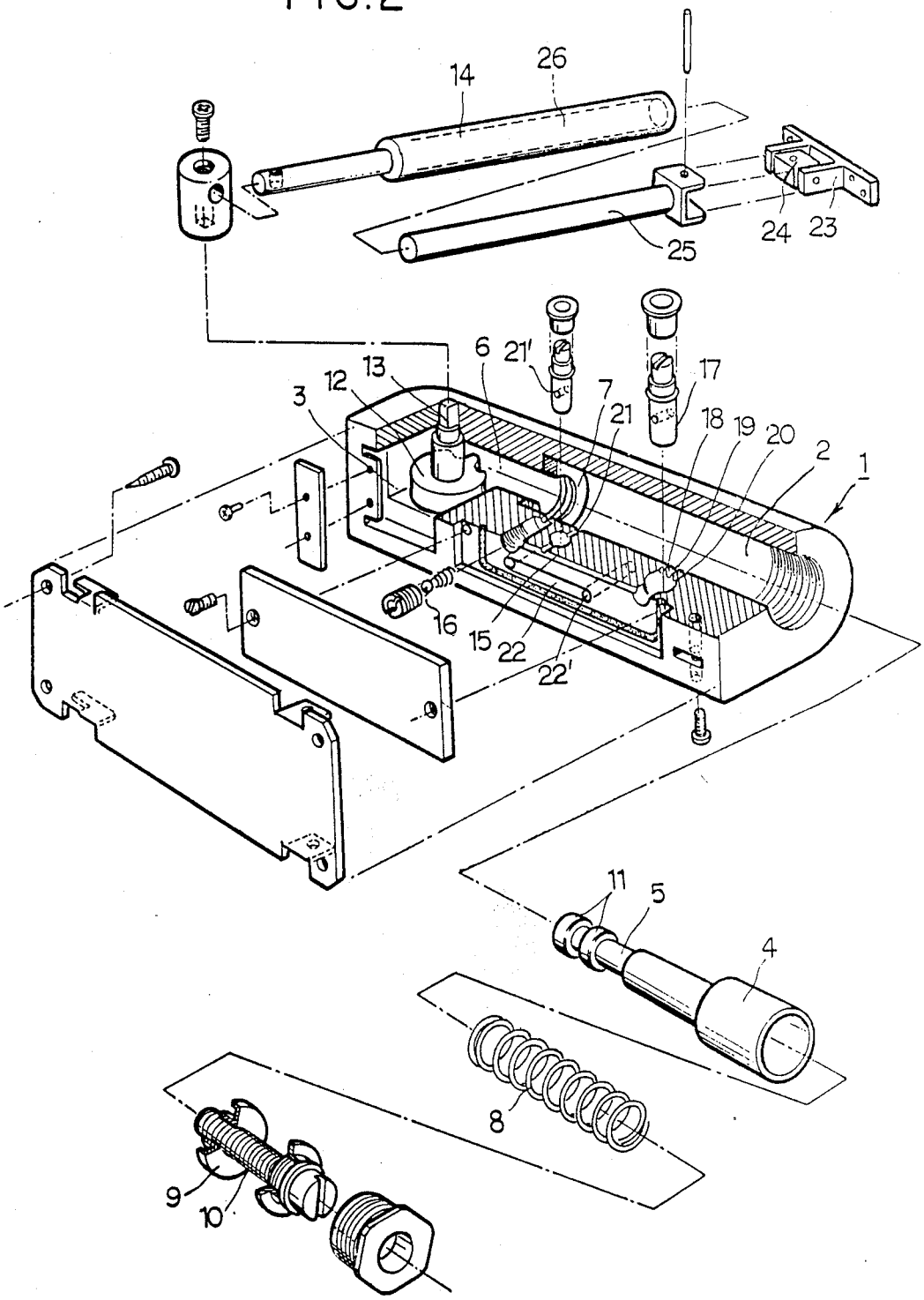
FIG. 2 is an exploded perspective view of the total constitution of the device of the present invention.
Figure 3:
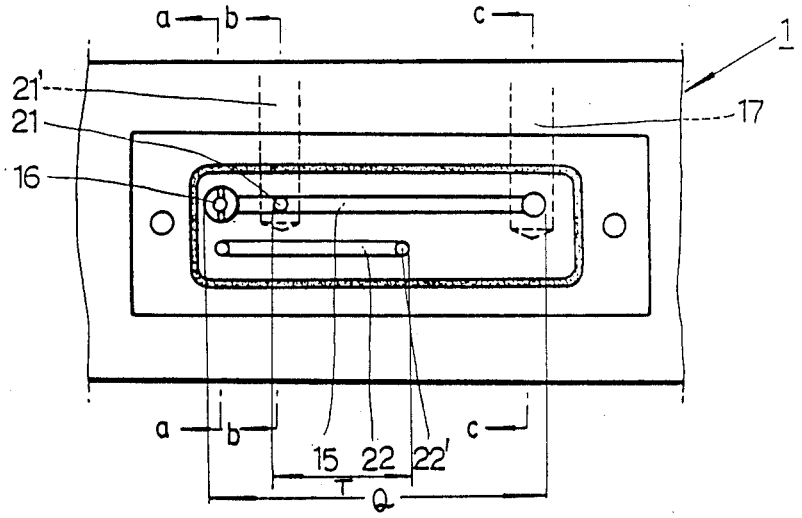
FIG. 3 is a bottom view showing the arrangement of the hydraulic passage.
Figure 4:
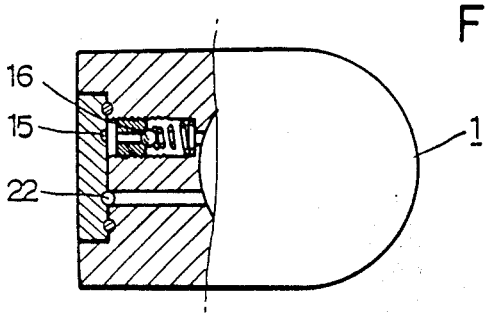
FIG. 4 is a sectional view taken along the line a—a of FIG. 3.
Figure 5:
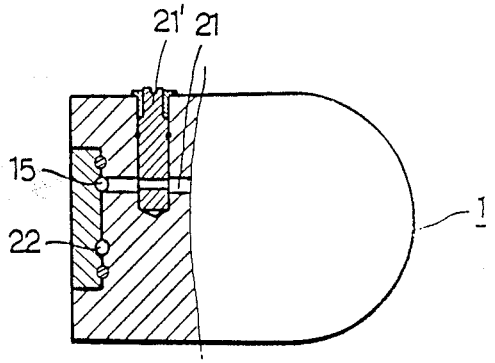
FIG. 5 is a sectional view taken along the line b—b of FIG. 3.
Figure 6:
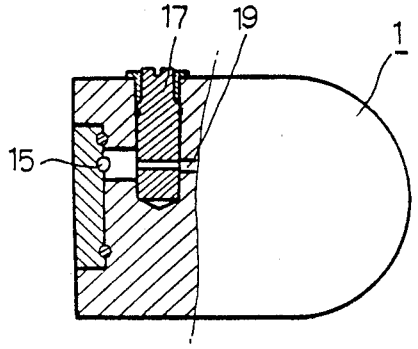
FIG. 6 is a sectional view taken along the line c—c of FIG. 3.

Inside the main body 1 of the door closer according to the present invention, there is formed an oil cylinder 2 in which the hydraulic oil is filled. Along the side opposite to the location of the oil cylinder 2, there is formed a groove portion 3, while the rod 5 of a piston 4 which is installed within the oil cylinder 2 can perform advances and withdrawals through a passage 6, the hydraulic oil being prevented from being leaked by means of a packing 7.

The piston is elastically supported by a spring 8, always receiving force in the forward direction, while the spring 8 is supported around an adjusting bolt 10 and onto a spring seat 9 in such way that the elastic force of the spring 8 can be adjusted.

Near the front end of the piston rod 5, there is provided two annular protrusions 11, these protrusions 11 being engaged with a disc-shaped cam having a single tooth. A driving shaft 13 for the cam 12 extends through the side wall of the main body 1 toward the outside in order to be connected to an arm 14, while the piston 4 moves forward and backward in accordance with the revolution of the cam 12.

Under the oil cylinder 2 within the main body 1, there is formed a hydraulic passage 15 which communicates to a point just before the advance limit for the piston 4, and to a point of the withdrawal limit of the same. Near the front end of the oil cylinder 2, there is provided a check valve 16, while near the rear end of the same, there are provided three small passages 18, 19, and 20, which are closed or opened by means of an orientation valve 17. Beside the hydraulic passage 15 and the check valve 16, there is formed an auxiliary passage 21 which is provided with an adjusting hole 21'. Therefore, the distance between the check valve 16 and the small passages 18, 19 and 20 corresponds to the maximum displacement of the piston 4. Besides the hydraulic passage 15, an auxiliary hydraulic passage 22 is provided.

The front end of the auxiliary hydraulic passage 22 communicates into the front end of the oil cylinder 2, while its rear end 22' communicates to a point before the small passages. The gap T between the rear end 22' and the auxiliary passage 21 is made equal to the length of the piston 4, thereby enabling for the piston 4 to close the both holes at the same time. In such an instant, the door comes to an angle of 30 degrees in the way of being closed, this being for braking the closing movement of the door in order to absorb the impact which the door otherwise should generate.

The small passages 18, 19 and 20 are adjusted by the orientation valve 17 by being closed or opened. If the first small passage 18 is opened by mating with the orientation valve 17, the door stops at an angle of 80 degrees, while the second small passage 19 makes the door stop at an angle of 90 degrees. Meanwhile the third small passage 20 is for realizing the stops of the door at arbitrary angles.

Inside the arm 14 which is connected to the driving shaft 13 of the cam 12, there is provided a cylinder 26, while a round rod-shaped slide arm 25 is joined in the form of a universal joint at its rear end to a pivoting block 24 which is pivotally fixed to a mounting bracket 23. The slide arm 25 is made to perform only straight movements in a state inserted into the cylinder 26.

The device of the present invention thus constituted will now be described as to its operating functions.

First the main body 1 of the door closer is installed onto a door, while the bracket 23 is installed onto the wall, or vice-versa. The arms 14 and 25 will pivot around the driving shaft 13, while the door will pivot around its hinges. In this context, the farther the driving shaft 13 is located from the hinges, the longer the arms 14, 25 have to be. Therefore, the device of the present invention has to be installed such that the position of the driving shaft 13 should be adequately near the hinges. In other words, the pivotal radius of the driving shaft 13 should be as shrt possible measured from the hinges, because this will give a favorable effect to the transmission of force.

Figure 7A:
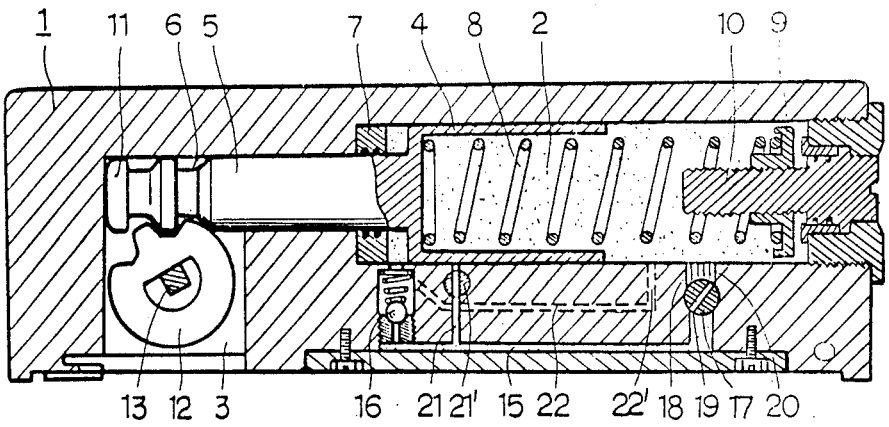
FIG. 7 shows the displacements of the piston in correspondence with the opening angle of the door, in which (A) shows the state before the movement of the piston, (B) the state of the beginning of the withdrawal of the piston, and (C) the state after the withdrawal of the piston.
Figure 7B:
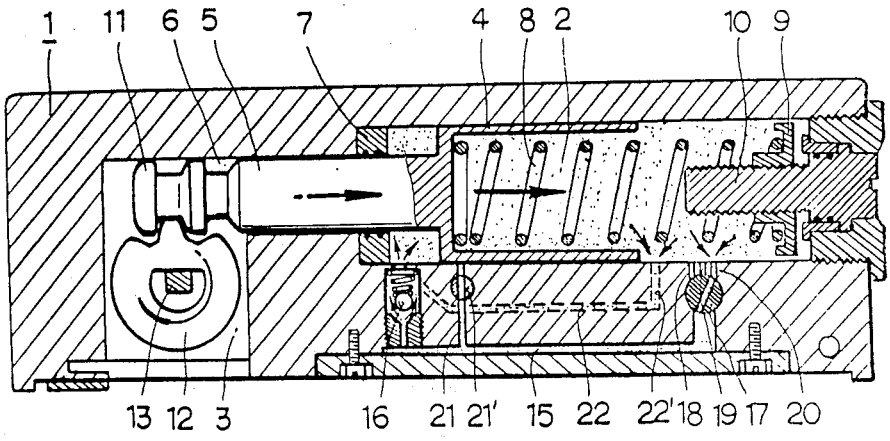
Figure 7C:
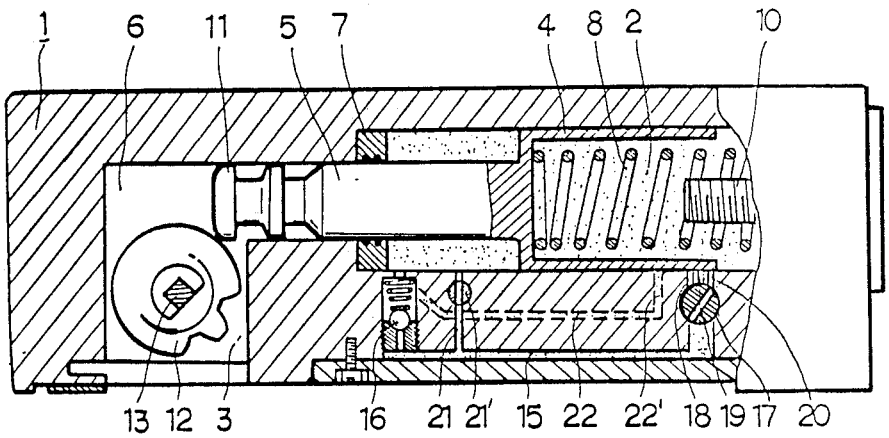

On the contrary, the inner cam 12 which is integrally fixed with the driving shaft 13 performs a pivoting in an opposite direction from the pivoting direction of the door, this being illustrated in FIG. 7 (A), (B) and (C). Therefore, the annular protrusions 11 provided on the piston rod 5 compress the spring 8 through the rotation of the cam 12, and the piston moves in the rightward direction. At the same time, the hydraulic pressure due to the force of the piston 4 is transmitted through the hydraulic passage 22 to the leftward direction in order to push the piston 4 to the opposite direction.

As the hydraulic pressure which is transmitted through the two hydraulic passages 15, 22 is relatively large, the door can be opened very lightly without requiring the exertion of much human force.

On the contrary, in the case where the door has to be pulled to open, the main body 1 of the device of the present invention can be installed in an inversed posture so that the driving shaft 13 should come to lower position. In this case, the driving shaft will come nearer to the hinges.

Now the operating functions of the arms 14, 25 and the main body 1 shall be described. If a closed door is pushed to open, the driving shaft 13 will turn around the hinge H, and therefore, the slide arm 25 which is connected to the bracket 23 will come out from the cylinder 26 as much as the angular distance of the turning of the driving shaft 13. This is illustrated in FIG. 9 (A), (B) and (C).

If the door is opened in this way to over 100 degrees, the piston 4 will close the small passages in order to block off the transmission of the hydraulic pressure, and at the same time, the tooth of the cam 12 will be disengaged from the annular protrusions 11 of the piston rod 5. Therefore the cam 12 will perform only idle revolutions, and there will be no further movement of the piston 4. In this state, the forces of the hydraulic pressure or the spring can not reach the door, and the controlling force is completely released from the door, whereby enabling it possible to stop the door at any arbitrary angle.

Accordingly, beyond a 100 degree angle of the door, the annular protrusions 11 will be in an engaged state with the cam 12, and although the piston receives am advancing force from the spring 8, it can not advance due to the obstruction by the cam 12. Therefore the door comes into a freely turning state.

If the door is pulled from such free range into the angle range of less than 100 degrees, or if the door is released in the angle range of less than 100 degrees when opening it, then the cam 12 performs a reverse turning so as for the tooth of the cam 12 to be engaged with the annular protrusions 11, and the piston rod 15 withdraws, the piston 4 advancing due to the elastic force of the spring 8. At this time, the arms 14, 25 will receive turning force in the direction of the cam revolution. But the slide arm 25 is received into the cylinder 26 in order to shorten the working length of the arm 25, and the door is turned smoothly due to the universal joint type, which absorbs the impacts at all the turning angles.

Figure 8A:
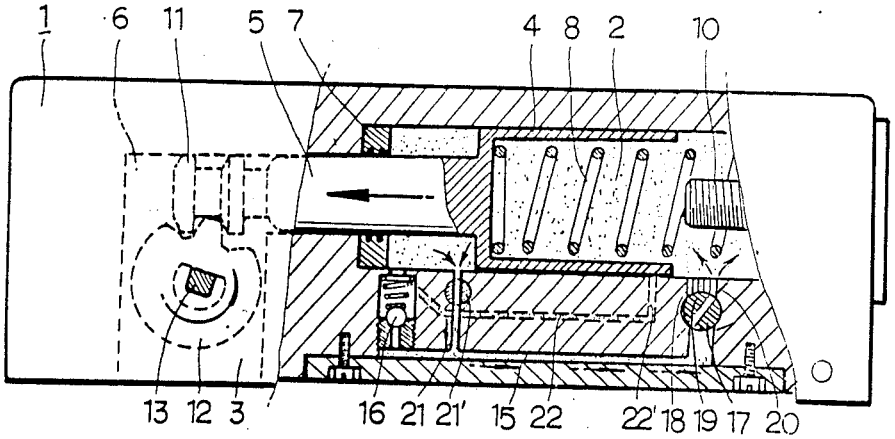
FIG. 8 shows the displacements of the piston in correspondence with the closing angle of the door, in which (A) shows the beginning of the advance of the piston, (B) the safety speed phase at the remaining angle of 30 degrees, and (C) the state after the finish of the advance of the piston.
Figure 8B:
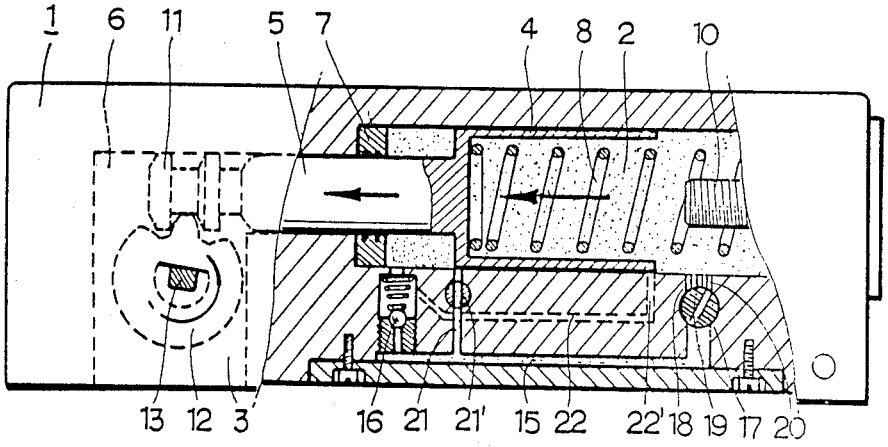
Figure 8C:
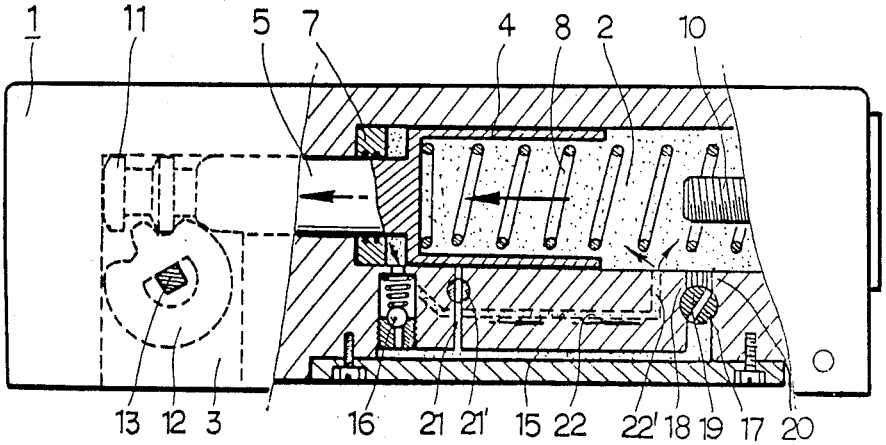
Figure 9A:
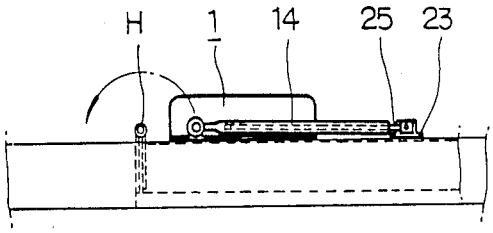
FIG. 9 shows the opened and closed states of the door, in which (A) shows the closed state, (B) an opened state at an angle of 90 degrees, (C) the free pivoting state after being opened beyond 90 degrees, and (D) the state of the preliminary stop at an angle of 30 degrees during a closing movement.
Figure 9B:
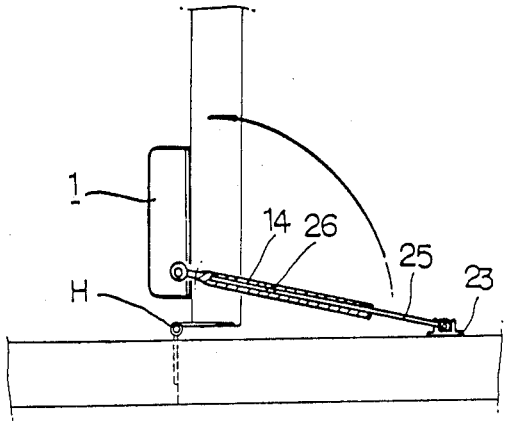
Figure 9C:
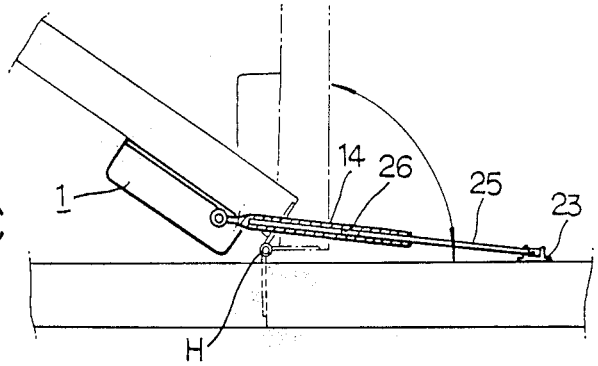
Figure 9D:
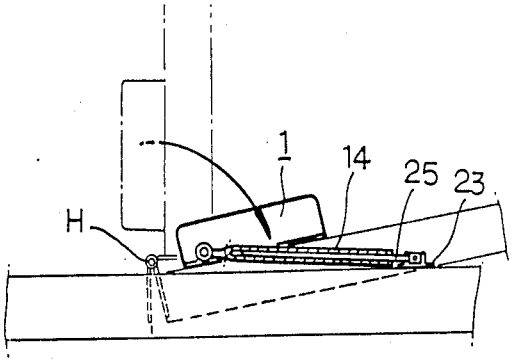
Figure 10:
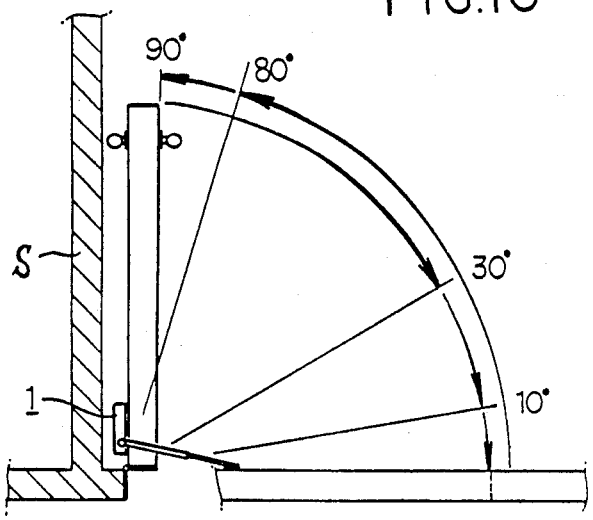
FIG. 10 shows the divisions of the angle, in each of which the closer performs a particular function.

Thus the movement of the piston 4 opens the small passages, and the hydraulic pressure is transmitted from the left through the auxiliary passage 21 and the hydraulic passage 15 toward the right. Then the check valve 16 is closed, and the hydraulic pressure is transmitted only through the auxiliary passage 21. As the transmission rate of the hydraulic pressure is very slow in this situation, the movement of the piston 4 becomes very slow, and consequently the rush of the door is controlled. This is illustrated in FIG. 8 (A). Thus the closing speed of the door is proportionate to the transmission rate of the hydraulic pressure, and therefore, the closing speed of the door can be made slower compared with the opening speed of the door.

As shown in FIG. 8 (B), when the door reaches a short distance before the complete closing, the piston 4 closes both of the hydraulic passages 15, 22. In this situation, there is absolutely no transmission of the hydraulic pressure, and therefore, a momentary braking is applied on the closing door. During this braking moment, the piston 4 moves only by the elastic force of the spring 8, and as soon as the piston 4 passes this braking point, the hydraulic passages 15, 22 are opened again in order to allow a strong transmission of the hydraulic pressure, whereby completing the closing of the door in an accelerated movement. When the piston 4 comes to close both of the hydraulic passages 15, 22, the door reaches the remaining angle of 30 degrees. From this point, the auxiliary hydraulic passage 22 is slowly opened, the hydraulic pressure is weakly transmitted rightward, and therefore, the door is slowly closed. When the piston moves further in order to completely open up the auxiliary hydraulic passage 22 (at the angle of 10 degrees), the door is closed in an accelerated speed. Thus the angular gap between 30 degrees and 10 degrees is the drastically decelerated section, and serves as a kind of safety measure.

If there is any hindering object in the opening range of the door, the orientation valve 17 can be adjusted to prevent the collision, for example, setting the valve 17 at 80 degrees. This is equivalent to setting at the small passage 18, and as soon as the piston 4 advances to close the small passage 18, the hydraulic passage 15 is closed, thereby preventing any further movement of the piston 4. Of course at this point, the cam 12 is engaged with the annular protrusions 11 of the piston rod 5, thereby absolutely preventing any further movement of the door. This is illustrated in FIG. 11 (A).

Figure 11A:
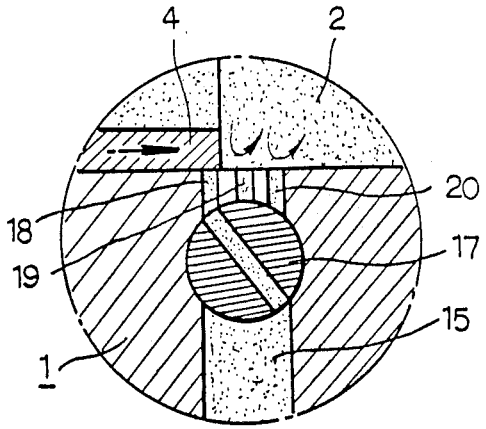
FIG. 11 shows the functions of the orientation valve, in which (A) shows the adjustment of the valve, adjusted to such extent that the door can be opened up to 80 degrees, (B) the adjustment of the valve, adjusted to such extent that the door can be opened up to 90 degrees, and (C) the adjustment of the valve, adjusted to such extent that the door can be opened up to 100 degrees and more.
Figure 11B:
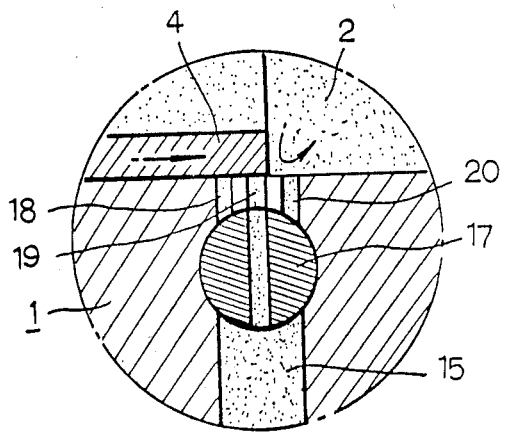
Figure 11C:
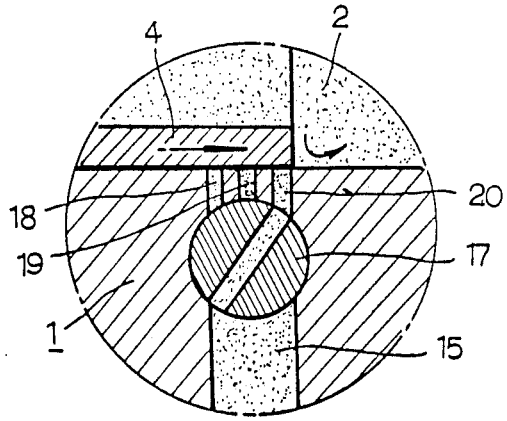

If it is desired that the door be opened up to the angle of 90 degrees, the orientation valve 17 is adjusted as shown in FIG. 11 (B) where the valve 17 is set at the small passage 19. In this case, the door will be opened only up to the angle of 90 degrees.

If there is no hindering object in the opening range of the door, and if the door is desired to be opened to the full range, the valve 17 is set at the small passage 20 as shown in FIG. 11 (C). In this case, when the piston 4 advances to close the small passage 20, the tooth of the cam 12 is disengaged from the annular protrusions 11, in order to perform only idle revolutions.

If a variation is desired to be given to the closing speed of the door due to different door weight or any other circumstance, the adjustment bolt 10 can be turned to adjust the tension of the spring 8, whereby giving the desired variation to the speed of the door.

The slide arm 25 is connected to the bracket 23 in a universal joint type that allows up, down, left and right pivotings, and will withstand a long period of wear and stresses.

The device of the present invention thus constituted will show a good appearance, the lack of deformations, and a good transmission of forces. Further, the provision of coupling between the tooth of the cam 12 and the annular protrusions 11 of the piston rod 5 helps the smooth working of the mechanism. Further the door can be maintained at any arbitrary angle beyond the usual opening range of 80 to 90 degrees. Further the provision of the separate hydraulic passage 15 and the hydraulic pressure transmission adjustment device enables easy adjustment of the closing speed of the door. Further the spring adjustment bolt 10 can be used to adjust the tension of the spring 8 by moving the spring seat 9 forward or backward. In this way, only one size of the device of the present invention is needed for application to different sizes of doors.

It should be understood that changes and modifications can be added to the preferred embodiment of the present invention described above without departing from the scope of the present invention.

What is claimed is:

1. A hydraulic door closer comprising:

a cam installed in a groove;

two annular protrusions formed at a front end portion of a piston rod, for engagement with the cam;

a first hydraulic passage having a middle auxiliary passage, provided under an oil cylinder within a main body of the closer;

a check valve provided at a front of an auxiliary passage;

an orientation valve;

three small passages closed or opened by the orientation valve; and a second hydraulic passage installed beside the first hydraulic passage in such a manner that the first and second hydraulic passages can be opened or closed according to a position of a moving attached to other end of said piston rod to regulate the flow rate of hydraulic fluid, for ultimately regulating the speed of a closing door.

2. The hydraulic door closer as claimed in claim 1, characterized in that the distance between the rear end of the second hydraulic passage and the middle auxiliary passage belonging to the hydraulic main passage is made equal to the length of the piston.

3. The hydraulic door closer as claimed in claim 1, characterized in that, of the three small passages, the first one is for setting the device to the maximum door-opening angle of 80 degrees, the second one is for setting to the maximum door-opening angle of 90 degrees, and the third one is for setting to 100 degrees plus a free moving range.

4. The hydraulic door closer as claimed in claim 1, characterized in that the cam is provided with a single tooth at one side.

* * * * *